US010854970B2

(12) United States Patent
Gölden et al.

(10) Patent No.: US 10,854,970 B2
(45) Date of Patent: Dec. 1, 2020

(54) PHASED ARRAY ANTENNA

(71) Applicant: ALCAN Systems GmbH, Darmstadt (DE)

(72) Inventors: Felix Gölden, Roßdorf (DE); Zhen Luo, Darmstadt (DE); Christian Weickhmann, Darmstadt (DE); Muhammed Ayluctarhan, Darmstadt (DE); Taimoor Naveed, Darmstadt (DE); Onur Hamza Karabey, Darmstadt (DE)

(73) Assignee: ALCAN Systems GmbH, Darmstadt (DE)

( * ) Notice: Subject to any disclaimer, the term of this patent is extended or adjusted under 35 U.S.C. 154(b) by 0 days.

(21) Appl. No.: 16/181,412

(22) Filed: Nov. 6, 2018

(65) Prior Publication Data

US 2020/0144718 A1 May 7, 2020

(51) Int. Cl.

| | |
|---|---|
| ***H01Q 3/44*** | (2006.01) |
| ***H01Q 21/00*** | (2006.01) |
| ***H01Q 1/38*** | (2006.01) |
| ***H01Q 21/06*** | (2006.01) |

(52) U.S. Cl.

CPC ..... *H01Q 3/44* (2013.01); *H01Q 1/38* (2013.01); *H01Q 21/0006* (2013.01); *H01Q 21/061* (2013.01)

(58) Field of Classification Search

CPC ..... H01Q 3/44; H01Q 1/38; H01Q 21/00; H01Q 21/06

USPC ..... 343/700 R

See application file for complete search history.

(56) References Cited

U.S. PATENT DOCUMENTS

| | | | |
|---|---|---|---|
| 5,355,104 | A | 10/1994 | Wolfson et al. |
| 5,537,242 | A | 7/1996 | Lim |
| 5,936,484 | A | 8/1999 | Dolfi et al. |
| 6,611,230 | B2 | 8/2003 | Phelan |
| 6,759,980 | B2 | 7/2004 | Chen et al. |
| 6,864,840 | B2 | 3/2005 | Zhu et al. |
| 7,145,412 | B2 | 12/2006 | Hunt et al. |
| 7,361,288 | B2 | 4/2008 | Lüssem et al. |
| 7,466,269 | B2 | 12/2008 | Haziza |
| 7,884,766 | B2 | 2/2011 | Haziza |

(Continued)

FOREIGN PATENT DOCUMENTS

| | | | |
|---|---|---|---|
| CN | 1373916 | A | 10/2002 |
| CN | 1728448 | A | 2/2006 |
| CN | 101283480 | A | 10/2008 |

(Continued)

*Primary Examiner* — Andrea Lindgren Baltzell
(74) *Attorney, Agent, or Firm* — Smartpat PLC

(57) ABSTRACT

A phased array antenna includes several antenna elements and a signal feed entry from or to which a signal is transmitted to or from the antenna elements. A phase shifting device modifies a phase difference of the signal that is transmitted from the signal feed network to the respective antenna element or that is transmitted from the respective antenna element to the signal feed network to adjust the preferred direction of radiation of the phased array antenna. A bias voltage is applied to each phase shifting device via two bias voltage electrode lines that are connected to a bias voltage driver. The bias voltage driver has several output channel terminal pairs with two output channel terminals to apply a tunable output channel voltage difference to each terminal pair. The two bias voltage electrode lines of each phase shifting device are connected to a respective terminal pair.

13 Claims, 4 Drawing Sheets

(56) References Cited

U.S. PATENT DOCUMENTS

| | | | | |
|---|---|---|---|---|
| 2002/0126048 | A1* | 9/2002 | Zhu | H01P 1/181 343/700 MS |
| 2005/0110595 | A1 | 5/2005 | Toit | |
| 2005/0128029 | A1 | 6/2005 | Lee et al. | |
| 2008/0116995 | A1 | 5/2008 | Kim et al. | |
| 2009/0091500 | A1 | 4/2009 | Haziza | |
| 2009/0278744 | A1 | 11/2009 | Kirino et al. | |
| 2012/0119141 | A1 | 5/2012 | Manabe et al. | |
| 2012/0182200 | A1* | 7/2012 | Manabe | G02B 27/0087 343/893 |
| 2018/0287254 | A1 | 10/2018 | Nakano et al. | |

FOREIGN PATENT DOCUMENTS

| | | | |
|---|---|---|---|
| CN | 101454941 | B | 11/2013 |
| EP | 0887879 | A1 | 12/1998 |
| EP | 2020051 | B1 | 9/2016 |
| EP | 2956986 | B1 | 2/2017 |
| EP | 2761693 | B1 | 5/2017 |
| JP | S5893002 | A | 6/1983 |
| JP | S6068701 | A | 4/1985 |
| JP | H077303 | B2 | 1/1995 |
| JP | H10145103 | A | 5/1998 |
| JP | 2000315902 | A | 11/2000 |
| JP | 2002330006 | A | 11/2002 |
| JP | 2005064632 | A | 3/2005 |
| JP | 2007110256 | A | 4/2007 |
| JP | 2009538565 | A | 11/2009 |
| WO | 9626554 | A1 | 8/1996 |
| WO | 2011009524 | A1 | 1/2011 |
| WO | 2011035863 | A1 | 3/2011 |
| WO | 2011036243 | A1 | 3/2011 |

* cited by examiner

PHASED ARRAY ANTENNA

TECHNICAL FIELD

The disclosure relates to a phased array antenna comprising several antenna elements, a signal feed network from or to which a signal is transmitted to or from the several antenna elements, and for each antenna element a corresponding phase shifting device, whereby the phase of each signal that is transmitted from the signal feed network to the respective antenna element or that is transmitted from the respective antenna element to the signal feed network is modified by the corresponding phase shifting device in order to adjust the superposition of each signal according to the preferred direction of radiation of the phased array antenna, and whereby for each phase shifting device a bias voltage is applied via two bias voltage electrode lines that are connected to a bias voltage driver.

BACKGROUND

For many applications a phased array antenna offers many advantages with respect to the reception and emission of information signals that are wirelessly transmitted between a transmitter and a receiver. By using a phased array antenna, the dominant direction of the information signal transmission or information signal reception of the phased array antenna can be varied over a wide angular range in order to increase the signal strength that is emitted to or received from a given direction.

Existing phased array antennas comprise a large number of antenna elements that are usually arranged on a flat level or on a substrate layer in a regular or matrix pattern. Each antenna element is connected to a signal feed network. If the phased array antenna is used for signal emission the signal feed network creates and distributes respective antenna signals that are transferred to the respective antenna elements and result in emission of an information signal that is the result of a superposition of all single antenna signals. If the phased array antenna is used for signal reception the respective antenna signals that are received by the corresponding antenna element are transferred to the signal feed network and the received information signal is composed from a superposition of all single antenna signals. Between the signal feed network and the antenna elements there is for each antenna element a dedicated tunable phase shifting device which allows for adding a tunable phase shift to the signal that runs along the phase shifting device. By adding an individual phase shift to the antenna signals that are emitted or received, the superposition of antenna signals can be controlled in order to provide for a dominant direction of the information signal transmission or information signal reception of the phased array antenna.

The tunable bias voltage that defines the phase shift which is generated by a respective phase shifting device is usually applied by a bias voltage driver. It is possible to operate the phase shifting devices with a dedicated bias voltage driver for each phase shifting device. However, connecting each phase shifting device with a suitable bias voltage driver requires costs and efforts for manufacturing and operating the phased array antenna.

Accordingly, there is a need for a phased array antenna that allows for easy and cost-saving manufacturing and that also allows for easy operation of the corresponding phase shifting devices resulting in a wide range of a respective phase shift of the antenna signal.

SUMMARY

The present disclosure relates to a phased array antenna as described above, characterized in that the bias voltage driver comprises several output channel terminal pairs with two output channel terminals whereby the bias voltage driver is able to apply a tunable output channel voltage difference to the terminal pair, and in that the two bias voltage electrode lines of each phase shifting device are connected to a respective terminal pair.

According to an advantageous aspect the bias voltage driver has a common voltage output channel terminal and a number of odd output channel terminals and just as many even output channel terminals, whereby the bias voltage driver is able to operate in a manner that the polarity of a voltage difference between any odd output channel terminal and the common voltage output channel terminal is opposite to the polarity of a voltage difference between any even output channel terminal and the common voltage output channel terminal, and whereby each terminal pair comprises an odd output channel terminal and an even output channel terminal.

According to one embodiment, each odd output channel terminal is arranged adjacent to a corresponding even output channel terminal, whereby an odd output channel terminal and the adjacent even output channel terminal form the terminal pair. It is considered advantageous to allow for using multi output channel drivers that have been developed and that are currently used in a different field of application. Suitable drivers can be multi-channel digital to analog converters that are implemented as integrated circuits and are widely used for many different applications and voltage ranges.

There are so called source driver ICs available that are dedicated to controlling and operating liquid crystal displays (LCDs) with a large number of pixels for which an individual bias voltage must be applied with great precision and short response times. Even though within display applications each channel is connected to a corresponding pixel and dedicated to control said pixel, is it possible and advantageous to respectively combine two channels into terminal pairs and to connect a phase shifting device to such a terminal pair, i.e. to connect a single phase shifting device to two output channels of such a source driver, i.e. preferably to one even channel and one odd channel. Such specialized source driver ICs are usually used for operating LCD panels with dot inversion, whereby the operation control of the source driver IC is adapted to operate each output channel by quickly switching between voltage values of opposite polarity with respect to a fixed common voltage. For instance, specialized source driver ICs for use in display applications have been developed that provide a positive voltage value to a first output channel terminal and a negative voltage value to a second output channel terminal that is in close proximity or adjacent to the first output channel terminal, whereby the positive or negative voltage is produced as voltage difference to a common voltage which is usually in the middle of the voltage range of the source driver IC. The first output channel terminal can be an odd output channel terminal and the second output channel terminal can be an adjacent even output channel terminal. Apart from the opposite polarity, the voltage value of the first output channel terminal can be identical or different to the voltage value of the second output channel. With a preset timing, polarity of paired output channels changes e.g. from positive to negative voltage and from negative to positive voltage with respect to the same common voltage, whereas for each output channel and thus for each terminal pair the corresponding voltage value can be individually preset to a voltage value within the voltage range. Such a specialized source driver IC seems very suitable for use with a phased array antenna. Furthermore, such specialized source drivers are commercial off-the-shelf products which are available in large quantities at low cost.

Whereas in known display control applications each output channel is used to apply an appropriate voltage difference with respect to a fixed common voltage to a single pixel or cell of the display, here each phase shifting device is connected to two output channels, but not to a fixed common voltage, which allows for full use of the voltage range of the bias voltage driver irrespective of a fixed common voltage which is usually preset to a middle value within the range of a source driver IC. It is therefore advantageous to enlarge the achievable voltage range by not using the common voltage as a reference voltage that is dedicated and useful to conventional LCD applications, but to combine output channels with opposite polarity with respect to the common voltage. By combining such output channels into a terminal pair the liquid crystal molecules of the corresponding phase shifting device can be driven completely with higher bias voltage which is very advantageous since liquid crystal material suitable for phased array antennas usually require higher saturation voltage than that of a LCD. With display control applications the maximum voltage difference that is applied to a pixel or cell is the difference between a maximum voltage value or minimum voltage value of the output channel and the fixed common voltage, whereas the maximum voltage difference that can be applied to a phase shifting device is the difference between the maximum voltage value and the minimum voltage value of an output channel terminal pair, which is irrespective of the fixed common voltage.

Since the voltages in one output channel terminal pair with opposite polarities are allowed to have different magnitudes, a further advantageous aspect is that, while the tuning voltage range available for a phase shifter device is doubled, the absolute voltage resolution remains the same and the resolution with respect to the full voltage range is doubled compared to the use case of a conventional display application.

It is advantageous to combine two adjacent output channel terminals to form the terminal pair of the bias voltage driver that is connected with a respective phase shifting device. Due to the close proximity of the two terminals of the terminal pair, the corresponding bias voltage electrode lines can be arranged to run in close proximity to each other from the terminal pair of the bias voltage driver to the phase shifting device. This allows for short bias voltage electrode lines without elaborate arrangements of electrode lines or complex electrode line patterns. Short bias voltage electrode lines of identical or at least similar length allow for fast and undisturbed application of a preset bias voltage to the respective phase shifting devices, thus reducing the response time for adjusting each phase shifting device and for realigning the phased array antenna towards a new direction.

It is also possible to make use of a flat flexible cable that provides for a flexible connection of the output channel terminal pairs with a rigid flat-pin plug that allows for easy mounting and connecting with the bias voltage electrode lines of each phase shifting device. If required or advantageous, a reordering of some of the connection lines can be included within the flexible section of the flat flexible cable. Thus, it is possible to provide for a low-cost combination of odd and even output channel terminals into a terminal pair, whereby the corresponding odd and even output channel terminals are not adjacent to each other, but at a distance and separated by a number of other odd and even output channel terminals that are arranged in between.

According to an advantageous aspect the two bias voltage electrode lines that connect the phase shifting device to the terminal pair of the bias voltage driver are located next to each other in a non-overlapping manner between the terminal pair and the phase shifting device. Non-overlapping electrode lines are easily manufactured and help to reduce an undesired interference of the bias voltage that is applied to the phase shifting device via the bias voltage electrode lines.

According to an advantageous embodiment, the two output channel terminals of a terminal pair are arranged at the same level or at the same surface of a substrate layer, and that one of the two bias voltage electrode lines comprises a conductive cross-over between two different levels or two different surfaces of substrate layers resulting in connecting sections of the two bias voltage electrode lines that run into the corresponding phase shifting device at two different levels or two different surfaces of substrate layers. For some advantageous embodiments of the phase shifting device, such a phase shifting device comprises two electrodes or at least two electrode sections that are arranged at two different levels of the phase shifting device. Usually, such phase shifting devices comprise electrodes that are arranged at two different surfaces of a single substrate layer or that are arranged at two different surfaces of two different substrate layers of the phase shifting device. According to the advantageous embodiment, the bias voltage electrode lines comprise terminal sections that are arranged on the same level for connecting the bias voltage electrode lines with the bias voltage driver that has terminal pairs on the same level or on the same surface of a substrate layer. The bias voltage electrode lines also comprise connecting sections for connecting the bias voltage electrode lines to the phase shifting devices, but the connecting sections are at a different level or at a different surface of a substrate layer, namely the same level or the same surface of a substrate layer on which the corresponding electrode of the phase shifting device is located. Thus, the cross-over (via) between different levels or different surfaces of substrate layers can be positioned at a distance to the bias voltage driver as well as at a distance to the phase shifting device, which allows for a less complex design and for a reduced space requirement of the bias voltage electrode lines.

BRIEF DESCRIPTION OF THE DRAWINGS

The present disclosure will be more fully understood, and further features will become apparent, when reference is made to the following detailed description and the accompanying drawings. The drawings are merely representative and are not intended to limit the scope of the claims. In fact, those of ordinary skill in the art may appreciate upon reading the following specification and viewing the present drawings that various modifications and variations can be made thereto without deviating from the innovative concepts of the invention. Like parts depicted in the drawings are referred to by the same reference numerals.

DETAILED DESCRIPTION

Figure 1:
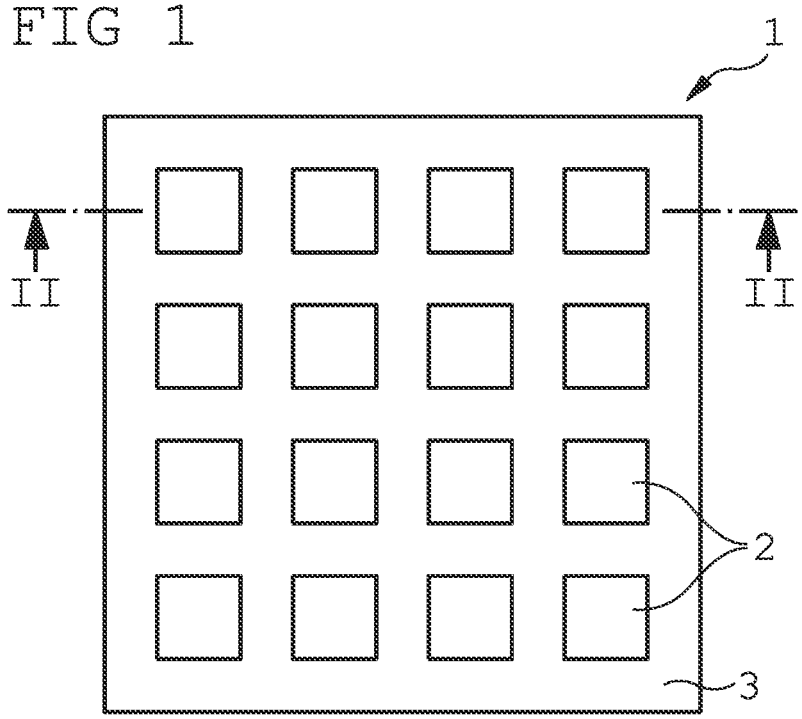
FIG. 1 illustrates a schematic top view of a phased array antenna with a 4×4 matrix of antenna elements.
Figure 2:
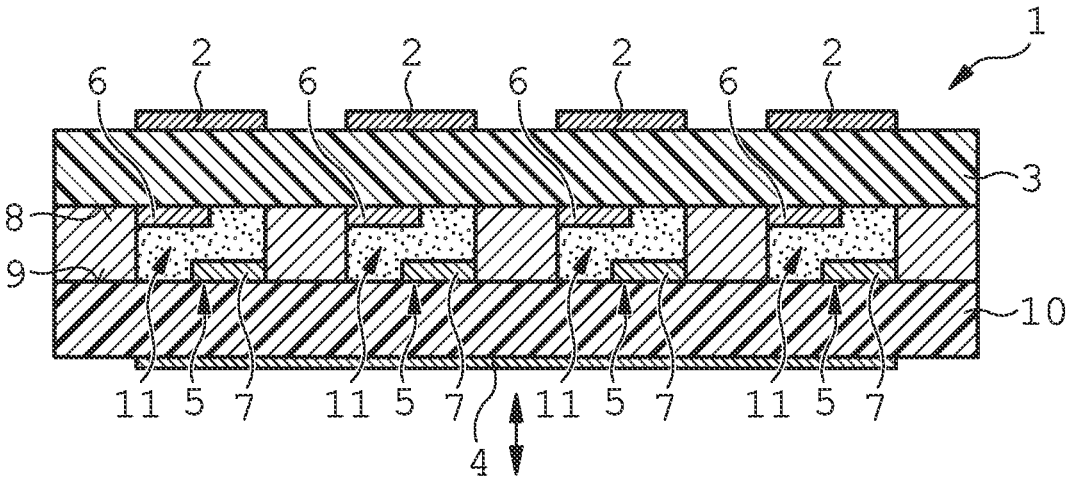
FIG. 2 illustrates a sectional view of the phased array antenna shown in FIG. 1 taken along the line II-II.

FIGS. 1 and 2 show a schematic top view and a schematic sectional view of an exemplary phased array antenna 1 with a 4×4 matrix pattern of antenna elements 2 that are arranged on the same level of a flat surface of a substrate layer 3 of the phased array antenna 1. However, for most applications the phased array antenna 1 comprises several hundred or several thousand antenna elements 2. Each antenna element 2 is connected to a signal feed network 4 via respective phase shifting devices 5. In order to allow for a suitable superposition of antenna signals of all antenna elements 2, each phase shifting device 5 is controlled by a bias voltage driver that applies individual bias voltages to the respective phase shifting devices 5. Each phase shifting device 5 generates a predetermined phase shift of the corresponding antenna signal that runs along the phase shifting device 5 which results in an advantageous superposition of the several antenna signals that are emitted or received by the antenna elements 2 of the phased array antenna 1. By applying suitable bias voltages to all of the phase shifting devices the superposition of all antenna signals emitted or received by the respective antenna elements 2 will result in an advantageous enhancement of a predetermined direction for emission or reception of the information signal emitted or received with the phased array antenna 1, thus enhancing the information signal quality and the signal to noise ratio of the information signal transmission along said direction.

Each phase shifting device 5 comprises two phase shifting electrodes 6, 7 that are usually arranged at different surfaces 8, 9 of two different substrate layers 3, 10. In between the two phase shifting electrodes 6, 7 at different substrate layers 3, 10 a tunable dielectric material 11 like e.g. liquid crystal material is arranged. For each phase shifting device 5 a dedicated reservoir of the tunable dielectric material 11 is confined by the two substrate layers 3, 10 and separator elements. By applying a bias voltage to the two phase shifting electrodes 6, 7 the dielectric characteristics of the tunable dielectric material 11 in between said two phase shifting electrodes 6, 7 is modified and set to a predetermined value, resulting in a corresponding phase shift that is applied to an antenna signal that is transferred along this phase shifting device 5. The appropriate bias voltage must be provided by a bias voltage driver that is not shown in FIGS. 1 and 2, and then applied to each of the phase shifting devices 5.

Figure 3:
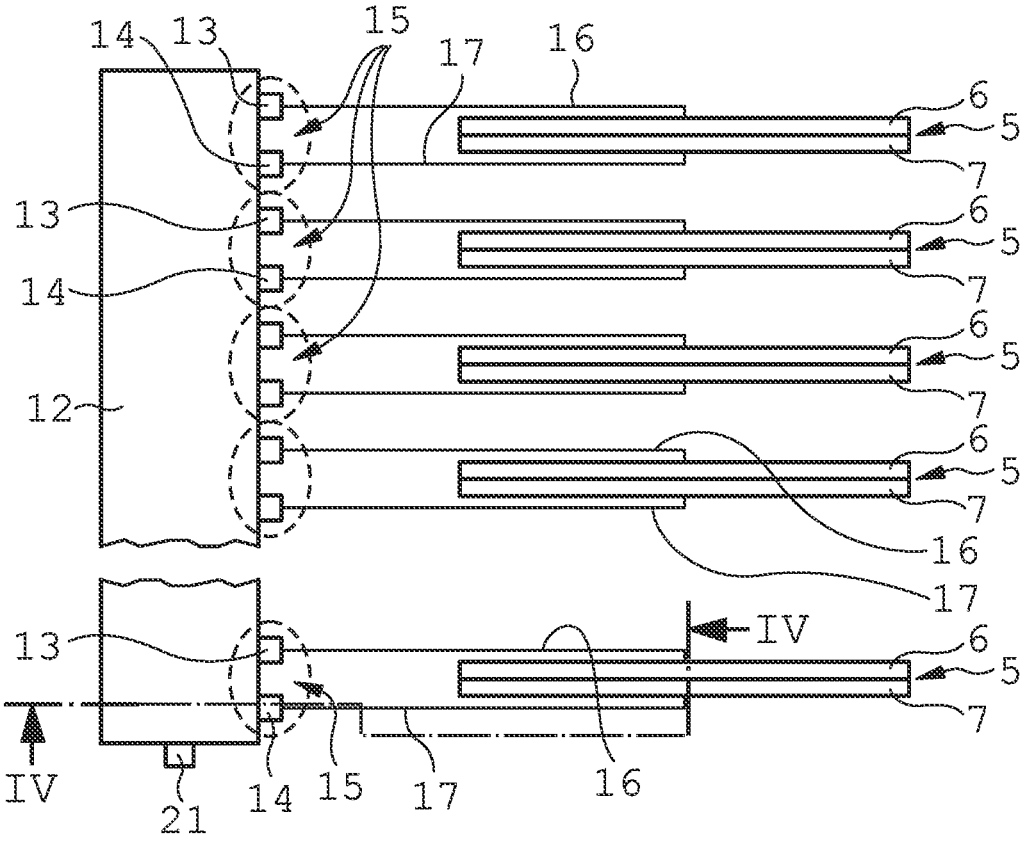
FIG. 3 illustrates a schematic view of a bias voltage driver of the phased array antenna that is connected to several antenna elements of the phased array antenna shown in FIGS. 1 and 2 in a direct drive configuration.
Figure 4:
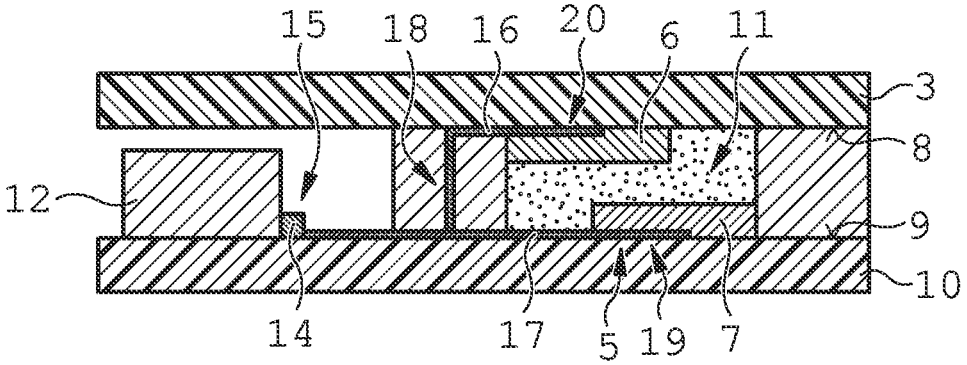
FIG. 4 illustrates a sectional view of the bias voltage driver and the corresponding antenna element connected to the bias voltage driver as shown in FIG. 3 taken along the line III-III.

FIGS. 3 and 4 illustrate a schematic view and a schematic sectional view of a part of the phased array antenna 1 with a bias voltage driver 12 of the phased array antenna 1 that is connected to several phase shifting devices 5 for respective antenna elements 2 of the phased array antenna 1. In FIG. 3 the bias voltage driver 12 is connected in direct drive configuration, i.e. one out channel terminal pair 15 is connected to exactly one phase shifting device 5. The bias voltage driver 12 is a commercial off-the-shelf source driver that is common and usually used for operating LCDs or similar display panels. Making use of a common LCD source driver allows for a very low-cost manufacture of the phased array antenna. The bias voltage driver 12 may also be a modified off-the-shelf source driver whereby the required modifications e.g. for pairing output channel terminals can be performed with low cost and reduced efforts. Each phase shifting device 5 requires an individual bias voltage that is applied to the phase shifting device 5 and determines the phase shift that is imposed onto an antenna signal that is transmitted by the corresponding phase shifting device 5.

The bias voltage driver 12 comprises a number of odd output channel terminals 13 and just as many even output channel terminals 14. Two adjacent output channel terminals 13, 14 of the bias voltage driver 12 form a terminal pair 15 that is indicated by a dashed border. Each output channel terminal 13, 14 of a terminal pair 15 is conductively connected to a dedicated phase shifting device 5 by two bias voltage electrode lines 16, 17. The two bias voltage electrode lines 16, 17 run from the terminal pair 15 to the corresponding phase shifting electrodes 6, 7 of the phase shifting device 5. For each phase shifting device 5 the corresponding two bias voltage electrode lines 16, 17 run next to each other in a non-overlapping manner between the terminal pair 15 and the phase shifting device 5, i.e. the two phase shifting electrodes 6, 7.

The bias voltage driver 12 is mounted on the same surface 9 of the same substrate layer 10 as one of the phase shifting electrodes 7 of the phase shifting device 5. The bias voltage electrode line 17 that connects the phase shifting electrode 7 with the terminal pair 15 runs along this surface 9 of said substrate layer 10. The other bias voltage electrode line 16 that connects the phase shifting electrode 6 mounted on the surface 9 of the substrate layer 3 comprises a conductive cross-over 18 between the two different surfaces 8, 9 of the corresponding substrate layers 3, 10. Thus, both bias voltage electrode lines 16, 17 comprise a connecting section 19, 20 that runs on the same surface 8, 9 of the substrate layer 3, 10 as the corresponding phase shift electrode 6, 7 to which the respective bias voltage electrode line 16, 17 is connected.

Figure 5:
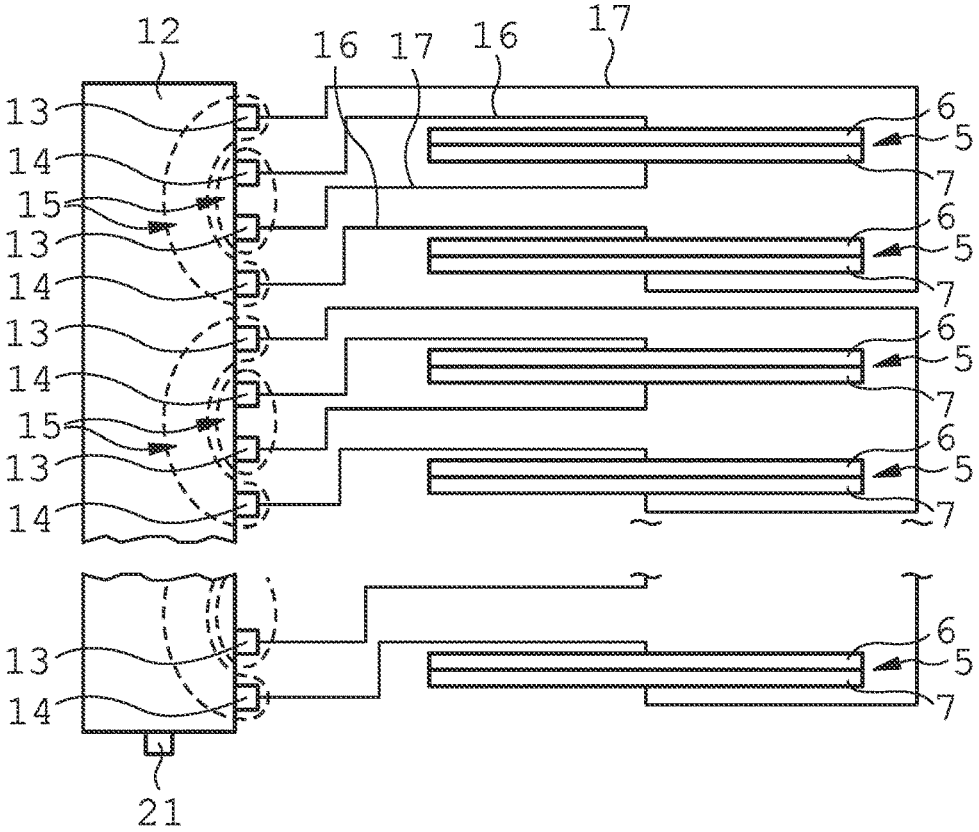
FIG. 5 illustrates a schematic view of another embodiment of a bias voltage driver of the phased array antenna that is connected to several antenna elements of the phased array antenna shown in FIGS. 1 and 2.

FIG. 5 illustrates a schematic view of a part of another embodiment of the phased array antenna 1. The bias voltage driver 12 of the phased array antenna 1 is connected to several phase shifting devices 5 for respective antenna elements 2 of the phased array antenna 1. However, contrary to the embodiment shown in FIG. 3, some terminal pairs 15 comprise an odd output channel terminal 13 and an even output channel terminal 14 that are separated by to output channel terminals 13, 14 in between. Thus, some of the terminal pairs 15 are formed by adjacent output channel terminals 13, 14 and some other terminal pairs 15 are formed by output channel terminals 13, 14 that are at a distance towards each other. Within the exemplary embodiment shown in FIG. 5, a suitable arrangement of the bias voltage electrode lines 16, 17 allows for a connection of the phase shifting devices 5 in a non-overlapping manner.

In both embodiments illustrated in FIGS. 3 and 5, the bias voltage driver 12 is a common LCD source driver that is commercially available at low cost. A common voltage terminal 21 that is used for operating thin film transistor LCDs is not used within the phased array antenna 1 and is thus not connected to a phase shifting device 5.

Figure 6:
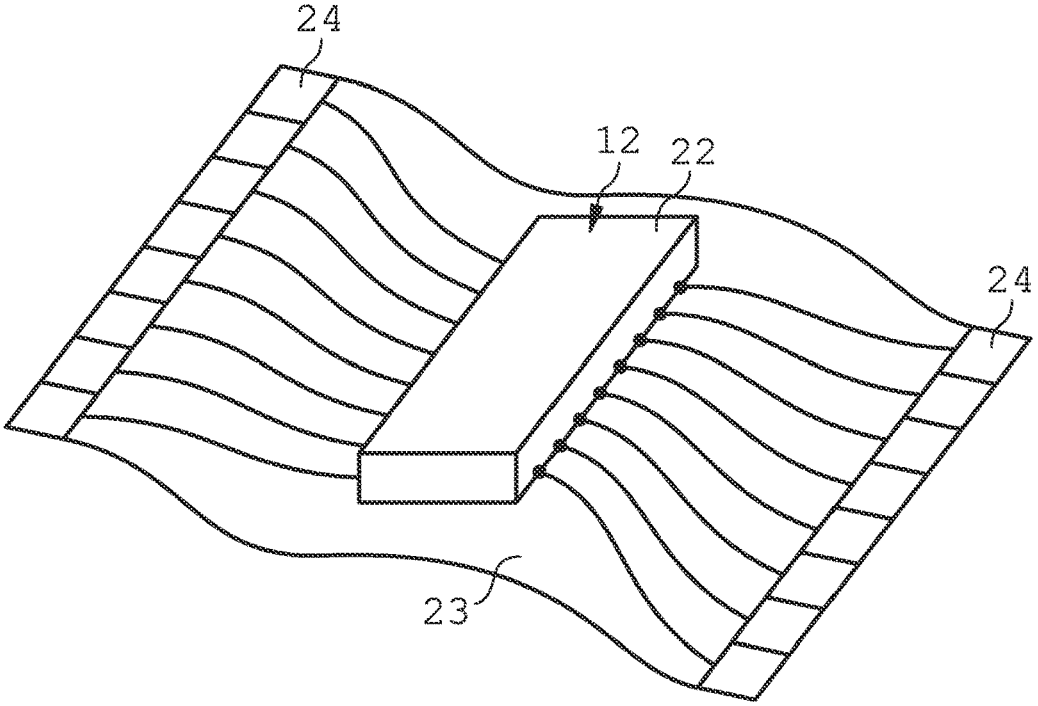
FIG. 6 illustrates a perspective view of a commercially available LCD source driver in combination with a flat flexible cable that can be used as bias voltage driver for the phased array antenna.

FIG. 6 shows a perspective view of a commercially available LCD source driver 22 in combination with a flat flexible cable 23 that can be used as bias voltage driver 12 for the phased array antenna 1. Within the flat flexible cable 23 some conducting wires may overlap and cross other conducting wires which allows for pairing distant or remote output channel terminals 13, 14 into a terminal pair 15 if need arises. However, in FIG. 6 a non-overlapping arrangement of the conducting wires is shown. The conducting wires on or within the flat flexible cable 23 connects the bias voltage driver 12 with respective rigid flat-pin plugs 24 that allow for easy mounting and connection with the bias voltage electrode lines that run to the phase shifting devices 5.

Figure 7:
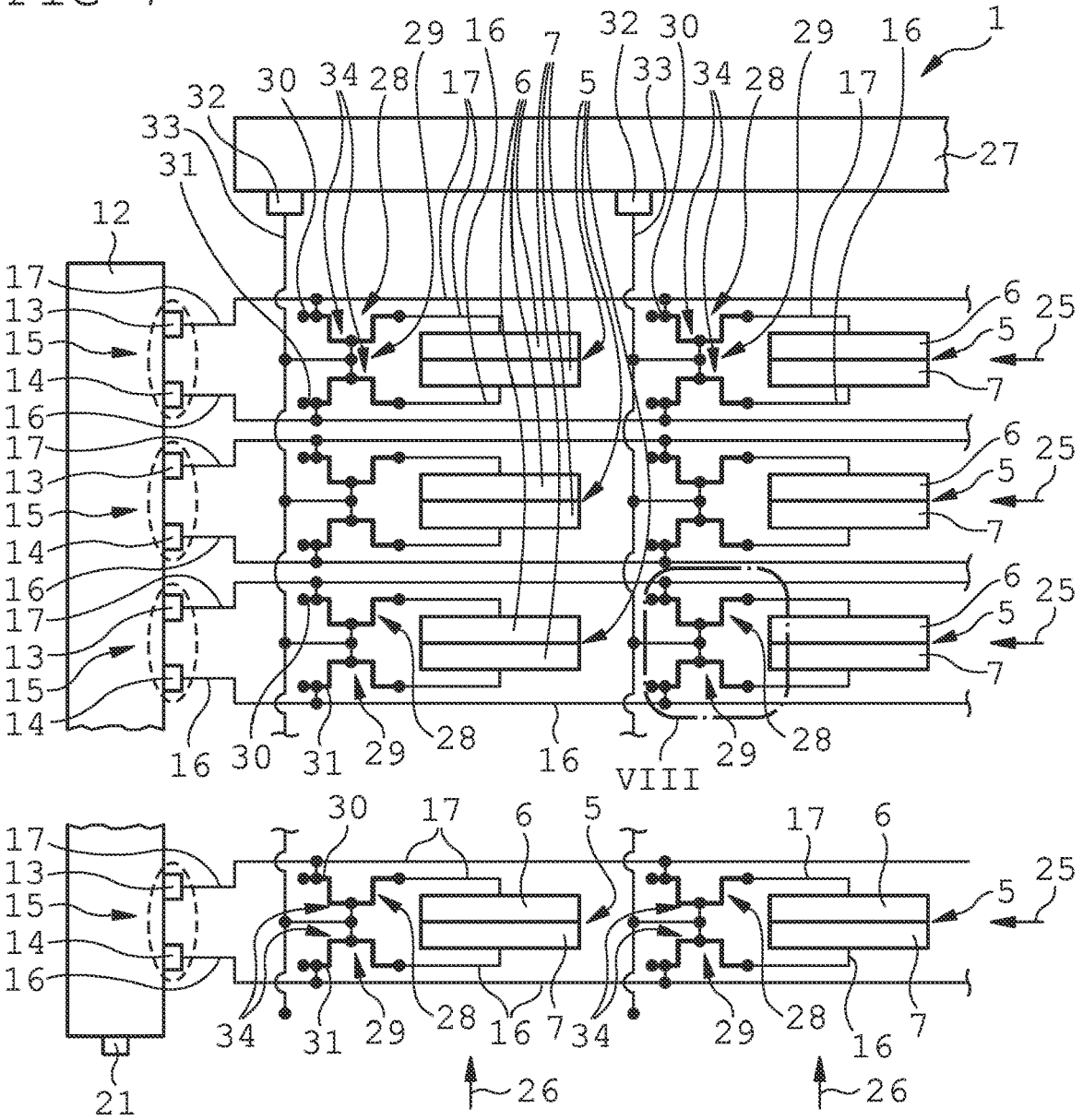
FIG. 7 illustrates an embodiment where the bias voltage driver is suitable to also drive source voltages of a TFT matrix.

FIG. 7 shows a schematic view of a part of yet another embodiment of the phased array antenna 1. This embodiment applies the pairing of odd and even output channel terminals 13, 14 to terminal pairs 15 not to a direct drive topology as shown in FIG. 3 but to a TFT matrix topology that is commonly used for operating TFT displays. The phase shifting devices 5 are arranged in an array of rows 25 and columns 26. In addition to the bias voltage driver 12 an additional gate driver IC 27 is required which is also available off-the-shelf. For each phase shifting device 5 a corresponding Thin-Film-Transistor (TFT) 28, 29 is provided. Source terminals 30 of all TFTs 28 related to phase shifting electrodes 6 are connected to odd output channel terminals 13. Likewise, the source terminals 31 of all TI-'1's 29 related to phase shifting electrodes 7 are connected to even output channel terminals 14. Equivalent to regular display applications, short gate voltage pulses are applied from the gate driver terminals 32 column 26 by column 26 to the gate voltage lines 33 to the gate terminals 34 of the TFTs 28, 29 in order to control and apply the voltages on all bias voltage electrode lines 16 or 17 to the drain of TFTs 28 and 29 and thereby to the phase shifting electrodes 6 and 7 of each phase shifting device 5.

Figure 8:
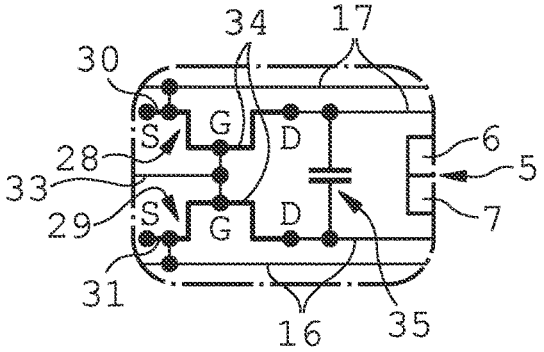
FIG. 8 illustrates an enlarged view of the region VIII of the embodiment shown in FIG. 7 with an optional addition to this embodiment.

FIG. 8 illustrates an enlarged view of the region VIII of FIG. 7. For each phase shifting device 5 a holding capacitor 35 can be arranged parallel to the respective phase shifting device 5. The TFTs 28, 29 are activated row by row with a given refresh rate of the gate driver IC 27. These capacitors 35 may be required for upholding and supporting the bias voltage if the tunable dielectric material 11 cannot hold the bias voltage for a long enough, or if the refresh rate of the gate driver IC 27 is low.

What is claimed is:

1. A phased array antenna, comprising:

several antenna elements;

a signal feed entry from which a signal is transmitted to or to which a signal is transmitted from the several antenna elements; and for each antenna element a corresponding phase shifting device, wherein a phase difference of each signal that is transmitted from the signal feed entry to the respective antenna element or that is transmitted from the respective antenna element to the signal feed entry is modified by the corresponding phase shifting device in order to adjust a superposition of each signal according to a preferred direction of radiation of the phased array antenna, wherein a bias voltage is applied to each phase shifting device via two bias voltage electrode lines that are connected to a bias voltage driver, wherein the bias voltage driver comprises several output channel terminal pairs, wherein each output channel terminal pair comprises two output channel terminals, wherein the bias voltage driver is able to apply a tunable output channel voltage difference to each terminal pair, and wherein the two bias voltage electrode lines of each phase shifting device are connected to a respective terminal pair.

2. The phased array antenna according to claim 1, wherein the bias voltage driver has a common voltage output channel terminal, a number of odd output channel terminals, and an equal number of even output channel terminals, wherein the bias voltage driver is able to operate in a manner that the polarity of a voltage difference between any odd output channel terminal and the common voltage output channel terminal is opposite to the polarity of a voltage difference between any even output channel terminal and the common voltage output channel terminal, and wherein each terminal pair comprises an odd output channel terminal and an even output channel terminal.

3. The phased array antenna according to claim 2, wherein each odd output channel terminal is arranged adjacent to a corresponding even output channel terminal, and wherein an odd output channel terminal and the adjacent even output channel terminal form the terminal pair.

4. The phased array antenna according to claim 2, wherein the bias voltage driver is suitable for use as a source driver for a thin film transistor matrix.

5. The phased array antenna according to claim 1, wherein the two bias voltage electrode lines that connect the phase shifting device to the terminal pair of the bias voltage driver are located next to each other in a non-overlapping manner between the terminal pair and the phase shifting device.

6. The phased array antenna according to claim 1, wherein the two output channel terminals of a terminal pair are arranged at the same level or at the same surface of a substrate layer, and wherein one of the two bias voltage electrode lines comprises a conductive cross-over between two different levels or two different surfaces of substrate layers resulting in connecting sections of the two bias voltage electrode lines that run into the corresponding phase shifting device at two different levels or two different surfaces of substrate layers.

7. A phased array antenna, comprising:

a plurality of antenna elements;

a signal feed electrically connected to the plurality of antenna elements by a plurality of phase shifting devices, one phase shifting device being arranged between each of the antenna elements and the signal feed;

a bias voltage driver having a plurality of output channel terminal pairs, each output channel terminal pair being formed by two output channel terminals; and two bias voltage electrode lines connecting each phase shifting device to a terminal pair of the bias voltage driver, the two bias voltage electrode lines being connected to one of the two output channel terminals each, wherein the bias voltage driver is configured to apply an adjustable output voltage to each terminal pair and thereby apply a selectable bias voltage to each phase shifting device.

8. The phased array antenna according to claim 7, wherein the bias voltage driver has a common voltage output channel terminal, a number of odd output channel terminals, and an equal number of even output channel terminals, wherein a differential voltage between any odd output channel terminal and the common voltage output channel terminal and a differential voltage between any even output channel terminal and the common voltage output channel terminal are of opposite polarity, and wherein each terminal pair comprises an odd output channel terminal and an even output channel terminal.

9. The phased array antenna according to claim 8, wherein each odd output channel terminal is arranged adjacent to a corresponding even output channel terminal, and wherein an odd output channel terminal and the adjacent even output channel terminal form the terminal pair.

10. The phased array antenna according to claim 8, wherein the bias voltage driver is a source driver for a thin film transistor matrix.

11. The phased array antenna according to claim 7, wherein the two bias voltage electrode lines that connect the phase shifting device to the terminal pair of the bias voltage driver are located next to each other in a non-overlapping manner between the terminal pair and the phase shifting device.

12. The phased array antenna according to claim 7, wherein the two output channel terminals of a terminal pair are arranged on a surface layer of a substrate, and wherein one of the two bias voltage electrode lines includes a conductive via from the surface layer of the substrate to a spatially separated second substrate layer.

13. The phased array antenna according to claim 12, wherein the phase shifting devices are arranged between the surface layer of the substrate and the spatially separated second substrate layer.

* * * * *